US009612077B2

(12) United States Patent
Kelly

(10) Patent No.: US 9,612,077 B2
(45) Date of Patent: Apr. 4, 2017

(54) ARCHERY RELEASE HAVING SIDE-POSITIONED FINGER INTERFACES

(71) Applicant: Scott Archery LLC, Clay City, KY (US)

(72) Inventor: Daniel N. Kelly, Rochester, NY (US)

(73) Assignee: Scott Archery LLC, Clay City, KY (US)

( * ) Notice: Subject to any disclaimer, the term of this patent is extended or adjusted under 35 U.S.C. 154(b) by 0 days.

(21) Appl. No.: 15/017,031

(22) Filed: Feb. 5, 2016

(65) Prior Publication Data

US 2016/0231077 A1 Aug. 11, 2016

Related U.S. Application Data

(60) Provisional application No. 62/112,431, filed on Feb. 5, 2015.

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
See application file for complete search history.

(56) References Cited

U.S. PATENT DOCUMENTS 3,656,467 A 4/1972 Halter
3,757,763 A 9/1973 Pinti et al.
3,768,456 A 10/1973 Hansen
3,853,111 A 12/1974 Stanislawski
3,965,884 A 6/1976 Killian
4,041,926 A 8/1977 Troncoso
4,424,791 A 1/1984 Muehleisen
4,567,875 A 2/1986 Fletcher
4,930,485 A 6/1990 Kopper
5,025,772 A 6/1991 Stevenson
5,666,936 A 9/1997 Estrada
5,685,286 A 11/1997 Summers
5,692,490 A 12/1997 Walker
5,694,915 A 12/1997 Summers
5,937,842 A 8/1999 Summers
6,571,786 B2 6/2003 Summers
6,584,966 B1 7/2003 Summers et al.
6,631,709 B2 10/2003 Carter
6,647,976 B2 11/2003 Summers et al.
6,712,060 B2 3/2004 Egusquiza
6,736,124 B2 5/2004 Carter
6,895,951 B2 5/2005 Summers et al.
6,945,241 B2 9/2005 Pellerite
6,953,035 B1 10/2005 Summers et al.
D597,164 S 7/2009 Jones
7,926,475 B2 4/2011 Jones
8,622,051 B2 1/2014 Summers
(Continued)

OTHER PUBLICATIONS

U.S. Appl. No. 15/008,962, filed Jan 28, 2016; inventors, Daniel N. Kelly and Eric J. Griggs.

(Continued)

*Primary Examiner* — John Ricci
(74) *Attorney, Agent, or Firm* — Barclay Damon, LLP

(57) ABSTRACT

A bowstring release is described herein. The bowstring release has, in an embodiment, a grip portion. The grip portion includes a front and sides. The front and sides are contoured or configured to be engaged with a plurality of fingers.

20 Claims, 25 Drawing Sheets

(56) References Cited

U.S. PATENT DOCUMENTS

| | | | |
|---|---|---|---|
| 8,746,221 | B2 | 6/2014 | Rentz |
| 8,869,781 | B2 | 10/2014 | Jones |
| 9,027,540 | B2 | 5/2015 | Springer |
| 9,261,323 | B2 | 2/2016 | Springer |
| 2003/0037778 | A1 | 2/2003 | Carter et al. |
| 2003/0154969 | A1 | 8/2003 | Carter |
| 2003/0159682 | A1 | 8/2003 | Pellerite |
| 2004/0079351 | A1 | 4/2004 | Summers et al. |
| 2008/0149084 | A1 | 6/2008 | Whalen |
| 2011/0168146 | A1 | 7/2011 | Deceuster |
| 2012/0192844 | A1 | 8/2012 | Springer |
| 2012/0285431 | A1 | 11/2012 | Summers |
| 2013/0025578 | A1 | 1/2013 | Jones |
| 2013/0092140 | A1 | 4/2013 | Rentz |
| 2015/0219418 | A1 | 8/2015 | Whalen |

OTHER PUBLICATIONS

Bow Lock downloaded from http://www.archery history.com/releases/releasespics/release5.jpg on Dec. 23, 2009.

Various prior art releases (1) downloaded from http://www.archeryhistory.com/releases/releasespics/pse.jpg, on Dec. 23, 2009.

Various prior art releases (2) http://www.archeryhistory.com/releases/releasepics/release4.jpg on Dec. 23, 2009.

Mamba R1 Swing Away E-Z Adjust downloaded from http://www.cobraarchery.com/c569.html, on Mar. 10, 2010.

Prior art releases (3) downloaded from http://www.archerhistory.com/releases on Jul. 21, 2011.

Prior art releases (4) downloaded from http://www.archerhistory.com/releases on Jul. 21, 2011.

Longhorn Hunter (2010).

Lancaster Archery Supply, Lancaster STAN Blacklce Release; downloaded from http://lancasterarchery.com/stan-blackice-release.html, on or before Mar. 5, 2013, 9 pages.

PRIOR ART

ARCHERY RELEASE HAVING SIDE-POSITIONED FINGER INTERFACES

CROSS-REFERENCE TO RELATED APPLICATION

This application is a non-provisional of, and claims the benefit and priority of, U.S. Provisional Patent Application No. 62/112, 431, filed on Feb. 5, 2015. The entire contents of such application are hereby incorporated by reference.

BACKGROUND

FIGS. 1A-1B depict an example of a known archery release 2. The known archery release 2 includes a housing 56 having a rear surface 58, a front surface 60, and at least two side surfaces 62, 64. The side surfaces 62, 64 join the front surface 60 to the rear surface 58. The known archery release 2 also has a top surface 66 and a bottom surface 68. A bowstring hook 70 is coupled to the housing 56, typically to the front surface 60, and is configured to hold a bowstring.

The known archery release 2 can include a plurality of finger positions 72 which together form a hand grip member 74. The finger positions 72 lie along a pulling plane 76. The pulling plane 76 includes a plane or planes which the fingers wrap around to contact the finger positions 72. This pulling plane 76 can be substantially perpendicular to the pulling direction 78. In use, an archer places several fingers in multiple finger positions to contact multiple finger positions 72, respectively. A bowstring (not shown) is placed in the hook 70 of the archery release 2, and the archer pulls the archery release 2 in a pulling direction 78, a linear direction in which the bowstring is pulled, to tension the bowstring. The tension can result in high loads on the archer's fingers. During this use, the front surface 60 of the archery release 2 faces the target, and the rear surface 58 faces the archer.

As shown in FIG. 1A, the front surface 60 is shaped or contoured to define multiple curved finger positions 72 while the rear surface 58 is flat and straight. The rear view of FIG. 1B illustrates the profiles of the side surfaces 58, 60. As illustrated, these side surfaces 62, 64 are flat and straight, resulting in a square or boxy side profile of the release 2. Thus, the known release 2 is limited to a two-dimensionally contoured shape, a shape that is contoured in only one plane.

There is another known archery release having an index finger slot, middle finger slot and ring finger slot. The front of this release has a curvature. The sides, however, are flat with a step-down shape. Each side has a first flat section extending along the index finger and middle finger slots. The first flat section steps down to a second flat section extending along the ring finger slot. These two flat sections do not provide separate finger positions for each of the three fingers. Furthermore, these flat sections are not shaped for ergonomic engagement with the separate fingers.

For these reasons, the known archery releases do not aid the archer in shooting with the optimal hand positioning In addition, the known archery releases provide insufficient ergonomic support for the hand during shooting. As a result of these disadvantages, the archer can experience inadequate shooting performance as well as pain or ailments related to his/her hand. For example, repetitive shooting with the known archery releases can cause finger or hand pain, bruising, swelling, strains or other medical conditions.

The foregoing background describes some, but not necessarily all, of the problems, disadvantages and shortcomings related to the known archery releases.

SUMMARY

A bowstring release is described herein. The bowstring release has, in an embodiment, a grip portion. The grip portion includes a front and sides. The front and sides are contoured or configured to be ergonomically engaged with a plurality of fingers.

In an embodiment, the archery bowstring release includes a bowstring hook configured to hold a bowstring and a hand grip member connected to the bowstring hook. The hand grip member includes a front surface and a rear surface opposite the front surface. The front surface extends along a front-facing plane or pulling plane. The hand grip member additionally includes a plurality of side surfaces coupling the front surface to the rear surface. Each of the side surfaces extends along a side plane. Each of the side surfaces is contoured to define at least a first finger interface and a second finger interface. The first finger interface and the second finger interface are separated by a crest extending perpendicular to the pulling plane.

In another embodiment, the archery release includes a release body including a grip portion. The grip portion includes a plurality of finger interfaces including an index finger interface, a middle finger interface, and a ring finger interface. The grip portion also includes a front surface defining a plurality of front valleys. Each of the plurality of front valleys at least partially defines one of the finger interfaces. The grip portion further includes a rear surface opposite the front surface, and the grip portion has a plurality of side surfaces. Each one of the side surfaces defines a plurality of side valleys. Each one of the plurality of side valleys at least partially defines one of the finger interfaces. The archery release further includes a bowstring hook coupled to the release body.

In yet another embodiment, the archery release includes a grip member. The grip member includes a first diameter, a front and a plurality of sides. The grip member further includes a three-dimensionally contoured shape extending at least around the front and the sides. The contoured shape defines at least a first finger interface and a second finger interface. The first and second interfaces each include a second diameter which is less than the first diameter. A bowstring holder is coupled to the grip member.

Additional features and advantages of the present disclosure are described in, and will be apparent from, the following Brief Description of the Drawings and Detailed Description.

DETAILED DESCRIPTION

Figure 1A:
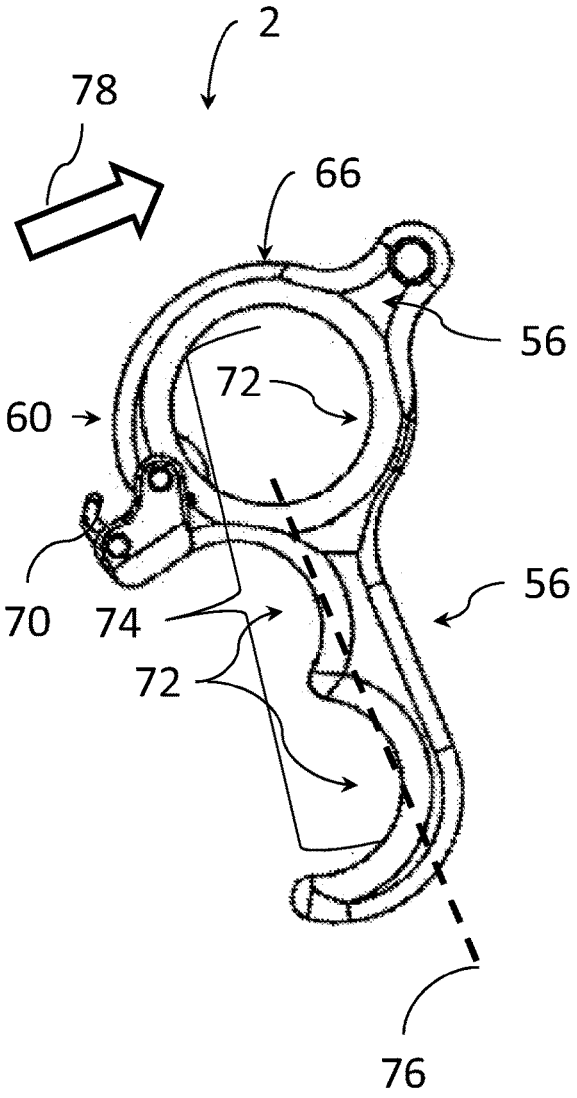
FIG. 1A is a side view of a prior art, conventional archery release.
Figure 1B:
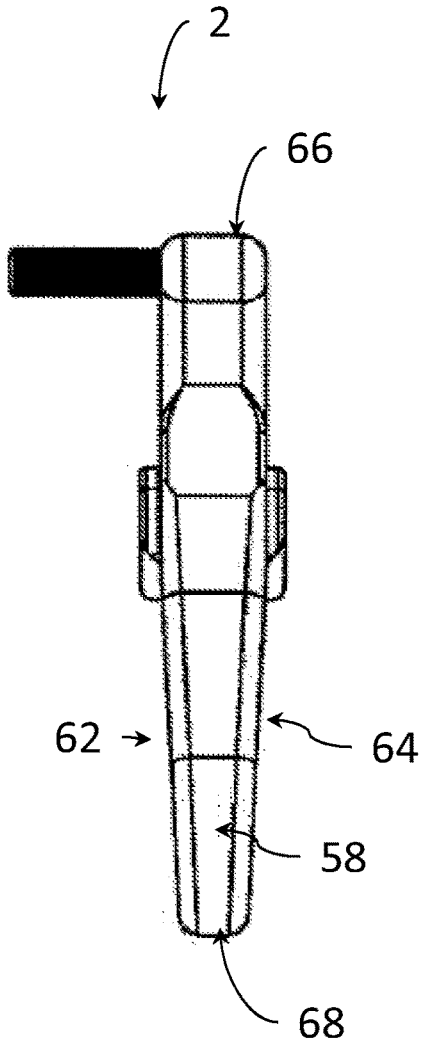
FIG. 1B is a rear view of the prior art, conventional archery release of FIG. 1.
Figure 2A:
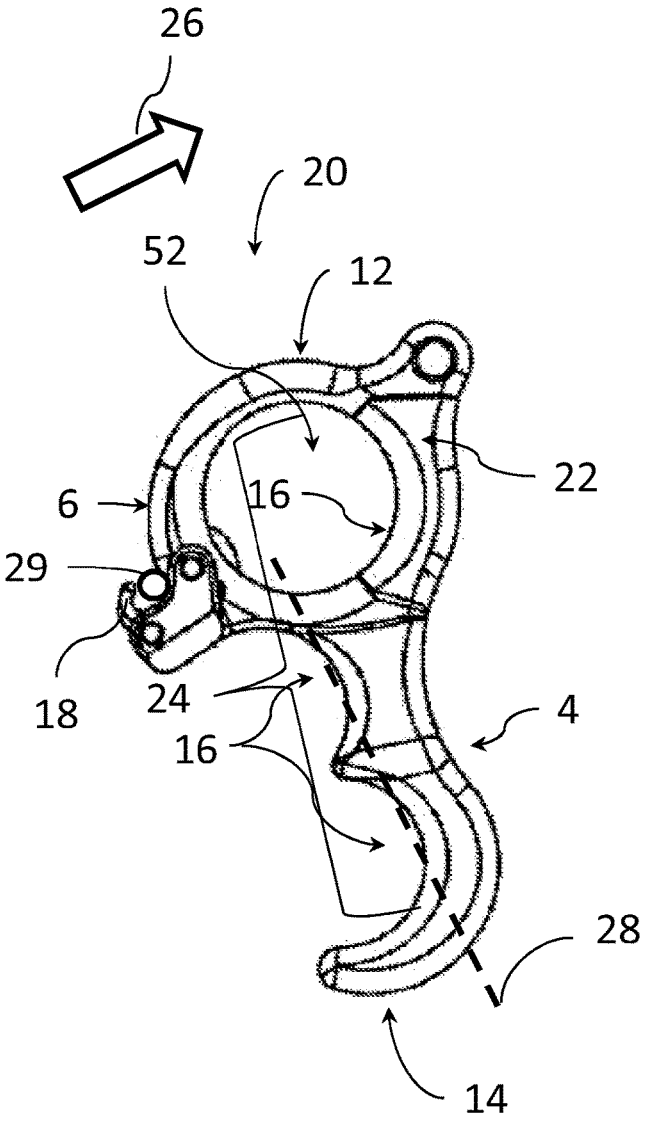
FIG. 2A is a side view of an embodiment of an archery release.
Figure 2B:
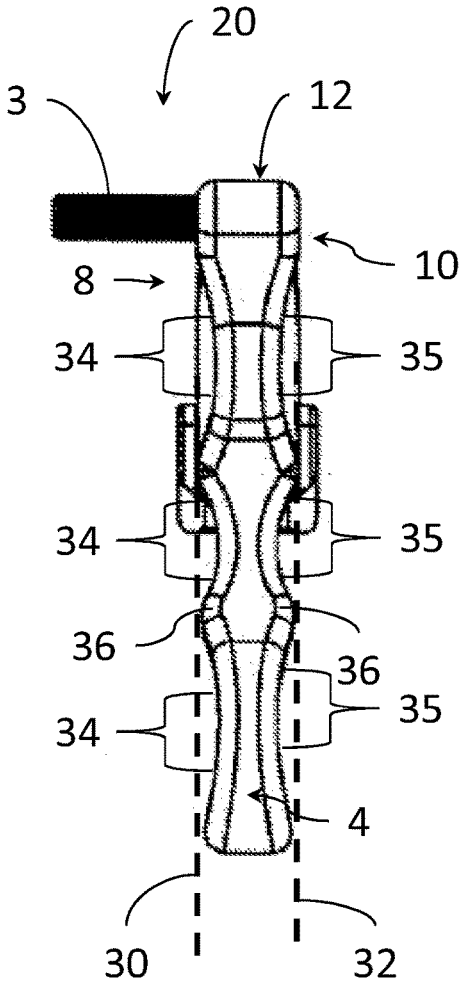
FIG. 2B is a rear view of the archery release of FIG. 2A illustrating side planes.
Figure 3:
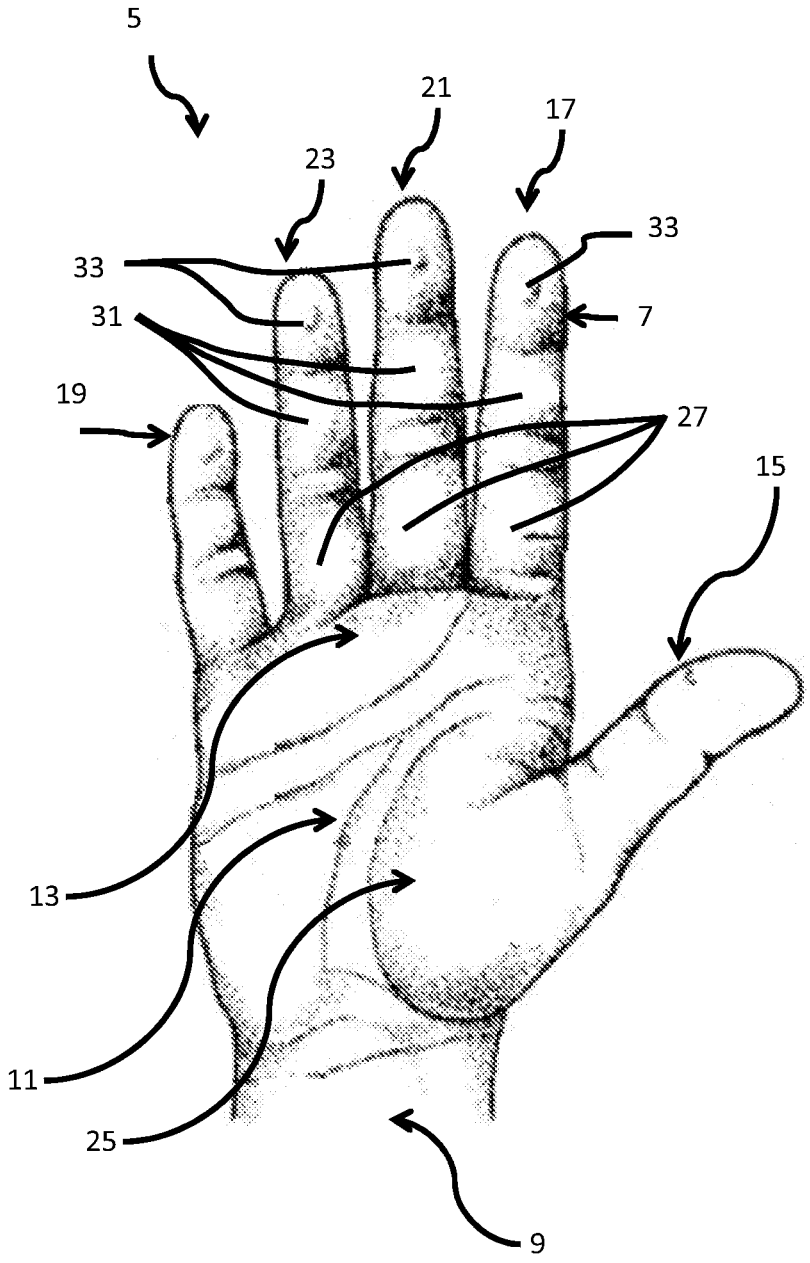
FIG. 3 is a front view of the palm side of the right hand of a user.

FIGS. 2A-2B depict side and rear views of an embodiment of an archery release 20 having a three-dimensionally contoured or shaped profile, or a shape that is contoured in multiple, intersecting planes. As depicted in FIGS. 2A-2B, the archery release 20 includes a housing 22 having a rear surface 4, a front surface 6, and at least two side surfaces 8, 10. The side surfaces 8, 10 join the front surface 6 to the rear surface 4. The archery release 20 also has a top surface 12 and a bottom surface 14. The archery release 20 also includes a thumb support 3 coupled to the housing 22. A bowstring holder or hook 18 is coupled to the housing 22, typically to the front surface 6, and is configured to releasably hold or secure a bowstring 29. In an embodiment, the bowstring hook 18 is pivotally coupled to the housing 22. In the embodiment shown, the archery release 20 is a triggerless, back tension archery release that includes a circular finger retention surface or ring-shaped index finger engagement surface that receives and engages the archer's or user's index finger 17 (FIG. 3).

The archery release 20 includes a hand grip or grip member 24. In an embodiment, the grip member 24 includes or defines a plurality of wave-shaped or curved finger positions, finger engagement surfaces, finger supports or finger interfaces 16. The finger interfaces 16 lie partially along the front plane or pulling plane 28. The front or pulling plane 28 includes one or more planes which at least partially face the shooting target during shooting.

Figure 4:
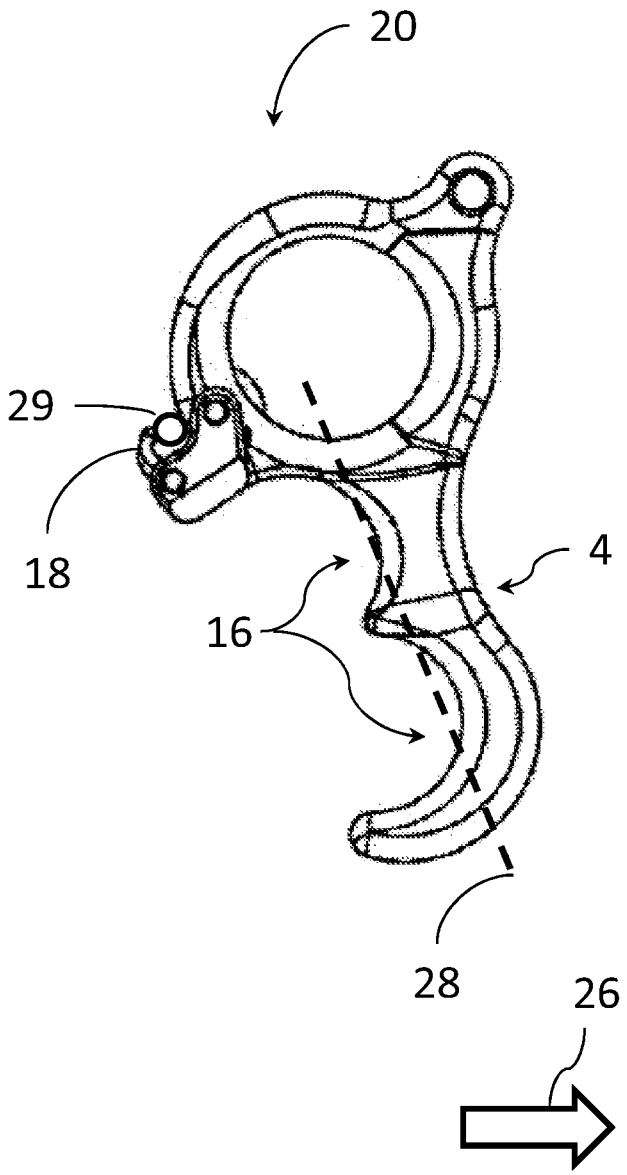
FIG. 4 is a side view of an embodiment of an archery release illustrating a front plane or pulling plane.

The ergonomic grip member 24 of the release 20 is configured to be engaged with the hand 5 of a user. As illustrated in FIG. 3, the user has a wrist 9 and the hand 5 has a palm 11, thumb 15, index finger 17, middle finger 21, and ring finger 23. The palm 11 has a thenar portion 25 at the base of the thumb 15. Each of the fingers 17, 21, 23 has: (a) a proximal phalanx or proximal portion 27; (b) a middle phalanx or middle portion 31; and (c) a distal phalanx or distal portion 33, commonly referred to as a fingertip. In an embodiment, the proximal phalanxes or proximal portions 27 of the hand 5 extend in the front or pulling plane 28 when the archer grasps the release 20. As such, the finger interfaces 16 engage and interface with the proximal portions 27. In use, a user places several fingers (including index finger 17, middle finger 21 and ring finger 23) in multiple finger interfaces 16, respectively. A bowstring 29 (FIGS. 2A and 4) is placed in the hook 18 of the archery release 20, and the user pulls the archery release 2 in the pulling direction 26 to tension the bowstring 29. During this use, the front surface 6 of the archery release 20 at least partially faces the target, and the rear surface 4 at least partially faces the user.

The side view of FIG. 2A provides a profile view of the front 6 and rear 4 surfaces. In this view, the front surface 6 is wave-shaped, configured or contoured to define multiple nonlinear, arced or curved finger interfaces 16. Furthermore, as illustrated in FIG. 2B, the side surfaces 8, 10 of the archery release 20 are also wave-shaped, configured or contoured to define multiple nonlinear, arced or curved surfaces or additional interfaces 34, 35. Depending on the user's hand size, gripping preference, and placement of the archery release 20 in the user's hand, these curved surfaces or additional interfaces 34 contact the user's fingers, palm, and/or both the fingers and palm.

Referring to FIGS. 2B and 3, in an example, a user may use his/her right hand 5 to hold the release 20. In this example, the release 20 engages the right hand 5 as follows:

(a) the interfaces 16 are at least partially engaged with proximal portions 27 of the right hand 5;

(b) the first additional interfaces 35 of side surface 10 are at least partially engaged with the distal palm region 13 of the right hand 5, the middle portions 30 of the right hand 5, or a combination of the distal palm region 13 and middle portions 30; and (c) the second additional interfaces 34 of side surface 8 are at least partially engaged with the middle phalanxes or middle portions 31 of the right hand 5.

As illustrated by FIG. 2B, side surfaces 8, 10 at least partially lie and extend in side-facing planes or side planes 30, 32, respectively. Each side-facing plane or side plane 30, 32 intersects with the front-facing plane or pulling plane 28. In the example, described above, the user's palm 11 is parallel to the front-facing or pulling plane 28 when the release 20 is in the user's hand and positioned for use.

Figure 5:
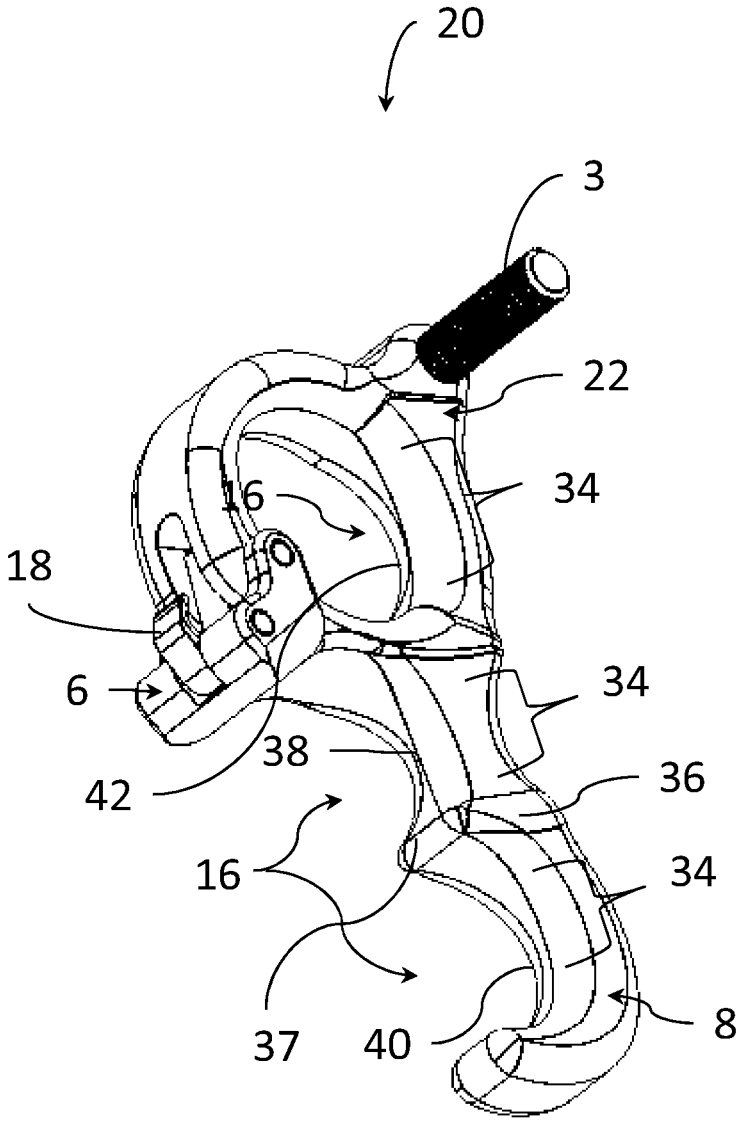
FIGS. 5 is an isometric view of an embodiment of an archery release.
Figure 6:
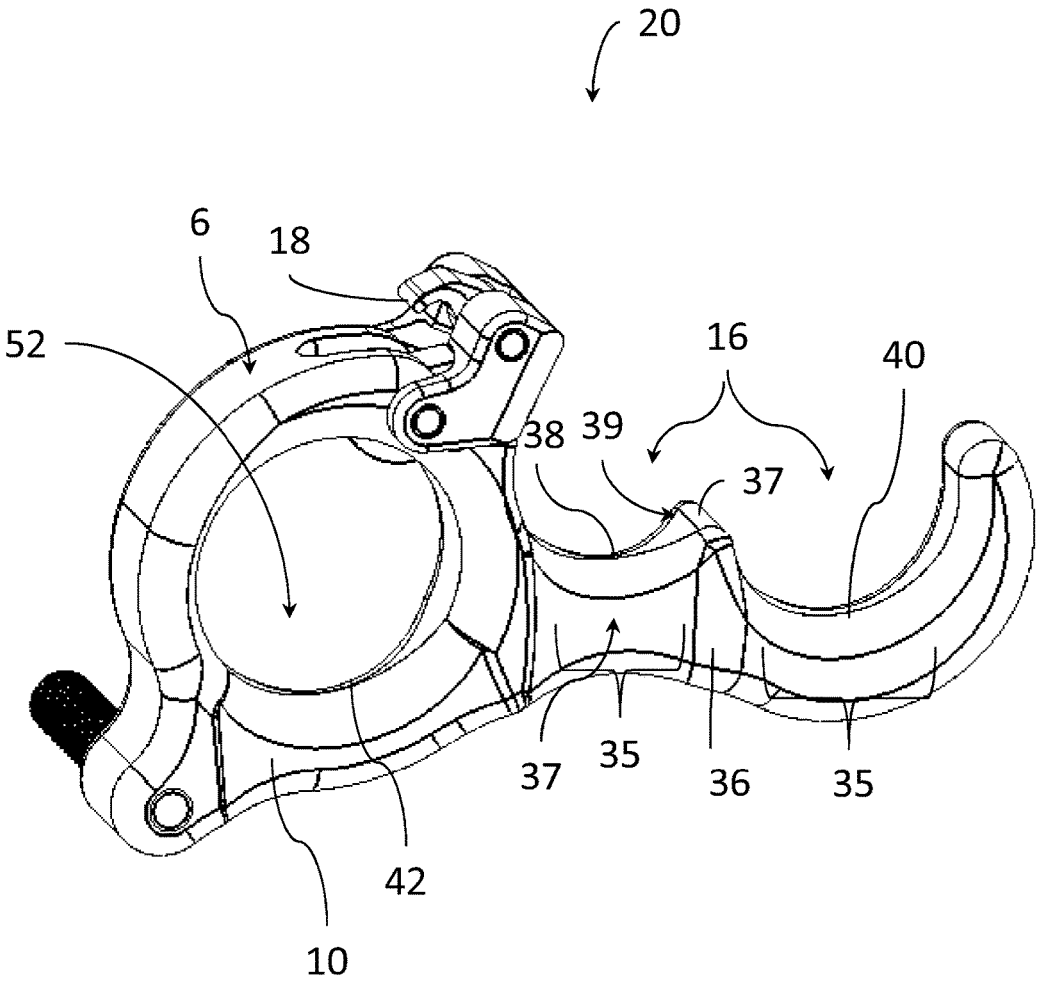
FIG. 6 is an isometric view of the archery release of FIG. 5.
Figure 7:
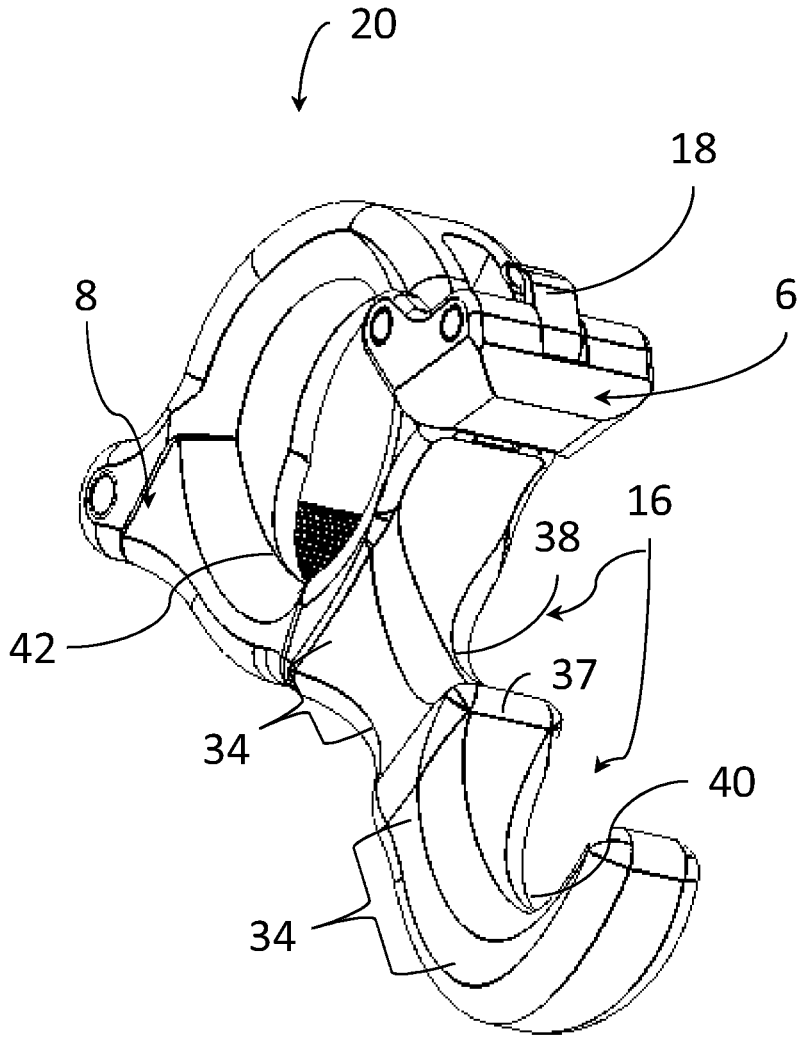
FIG. 7 is an isometric view of the archery release of FIG. 5.
Figure 8:
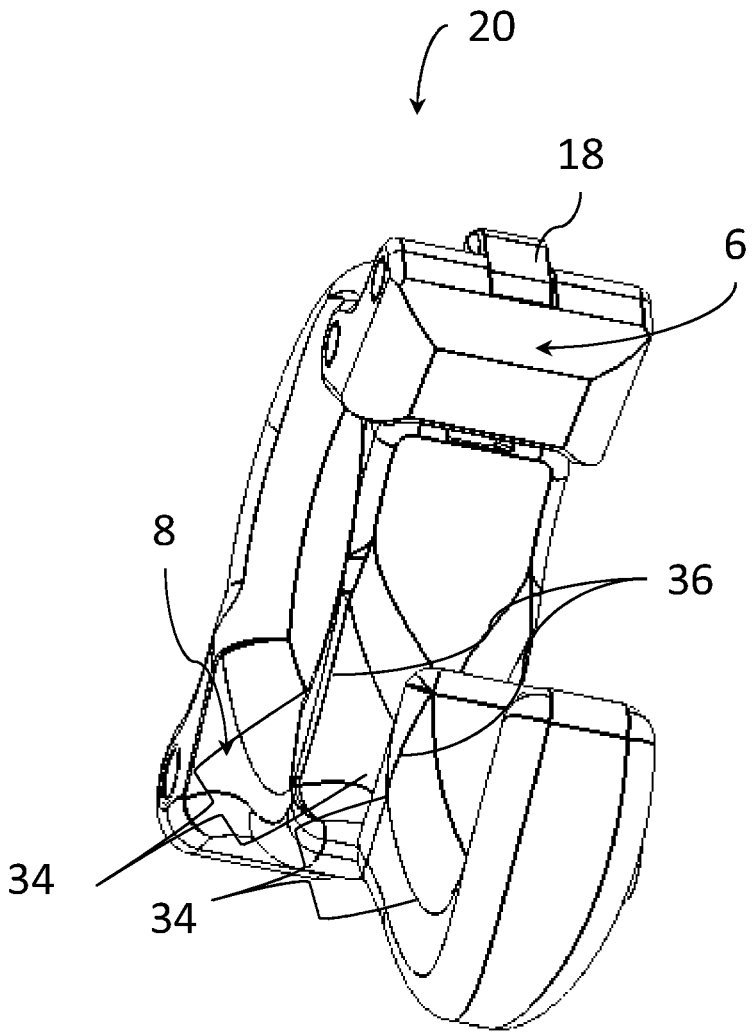
FIG. 8 is an isometric view of the archery release of FIG. 5.
Figure 9:
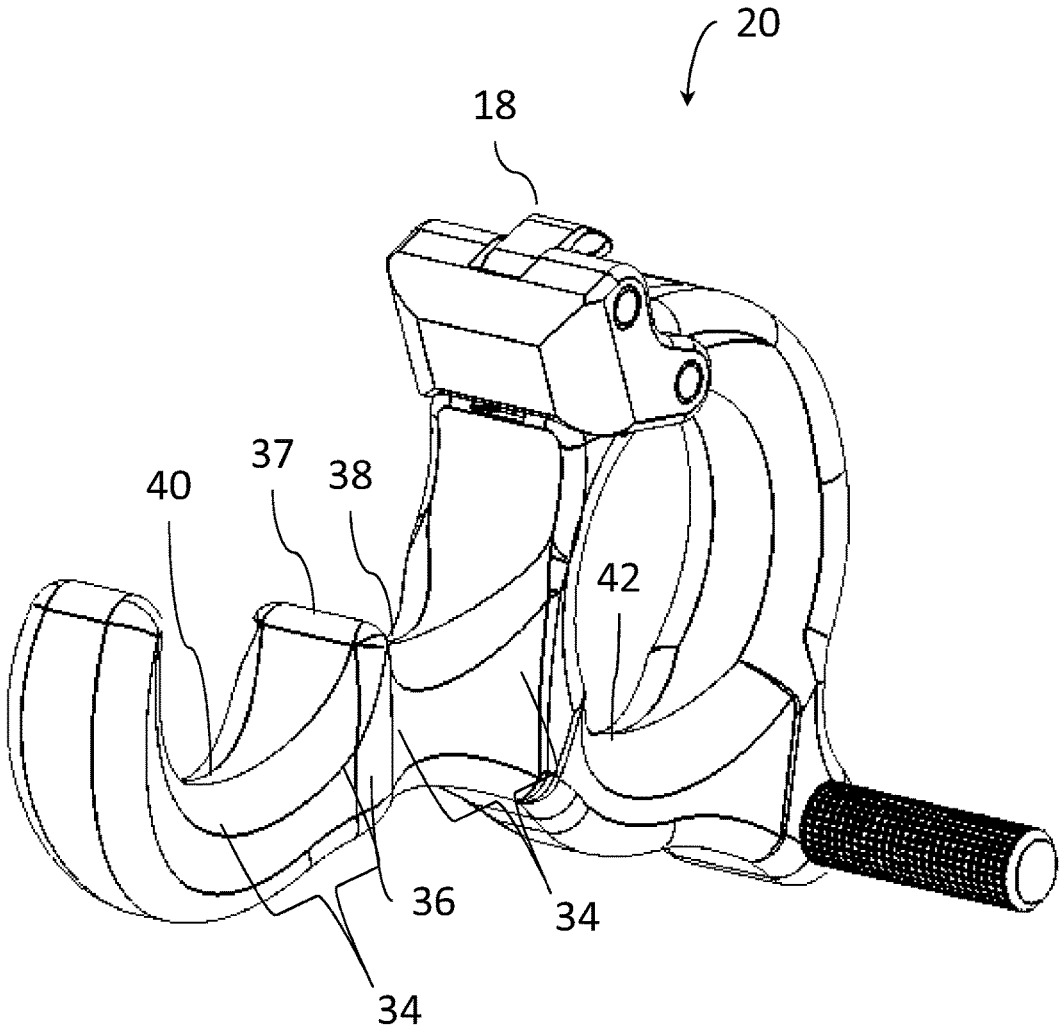
FIG. 9 is an isometric view of the archery release of FIG. 5.
Figure 10:
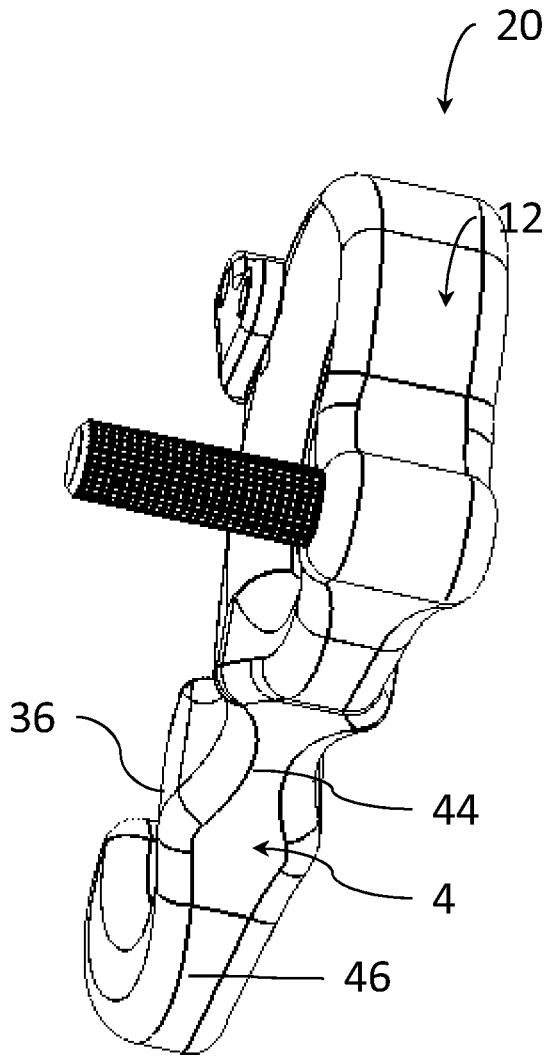
FIG. 10 is an isometric view of the archery release of FIG. 5.
Figure 11:
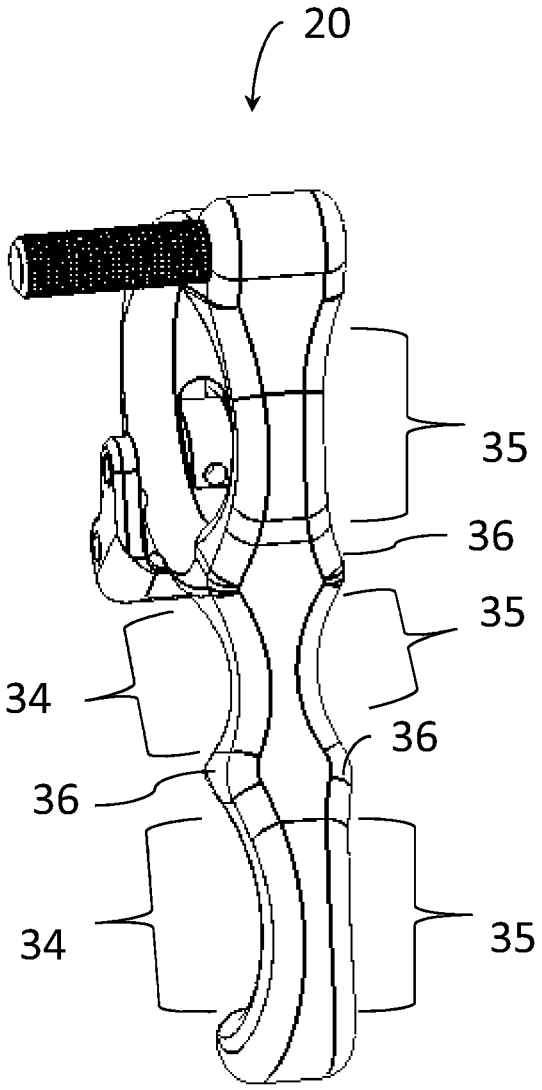
FIG. 11 is an isometric view of the archery release of FIG. 5.

FIGS. 5-15 illustrate various views of the archery release 20. Referring in particular to FIGS. 5 and 6, each side surface 8, 10 has a shaped profile that defines a plurality of curved recesses or finger retention surfaces or interfaces 34, 35. As illustrated in FIG. 6, the curved finger retention surfaces or interfaces 34, 35 each have a concave shape defining a valley 37. Each curved finger retention surface or interface 34, 35 is separated from the adjoining finger retention surface or interface 34, 35 by a raised section, finger separator, peak or crest 36. Crest 36 has a plurality of ramp or riser sections 39 configured to engage with the sides 7 of the fingers of the user's hand 5. With respect to the interfaces 34 of the side surface 8, each finger 17, 21, 23 dwells within a valley 37 and is engaged with, retained by, and at least partially surrounded by a plurality of riser sections 39. With respect to the interfaces 35 of the side surface 10, at least part of each finger 17, 21, 23 (and the associated portion of the distal palm region 13) dwell within a valley 37 and are engaged with, retained by, and at least partially surrounded by a plurality of riser sections 39. Each of the adjoining defined finger interfaces 16 are separated by a raised surface or crest 37. The crest 37 aligns with the crests 36 between the finger retention surfaces 34 to form a single crest 36, 37 extending across both side surfaces 8, 10 and the front surface 6. In an example, the crest 36, 37 extends perpendicular to the front or pulling plane 28 and the side plane 30, 32. In an embodiment, the back surface 4 can also be shaped and the crest 36, 37 can also extend across the back surface 4. In another embodiment, the back surface 4 can be shaped to retain a user's palm 11.

Figure 12:
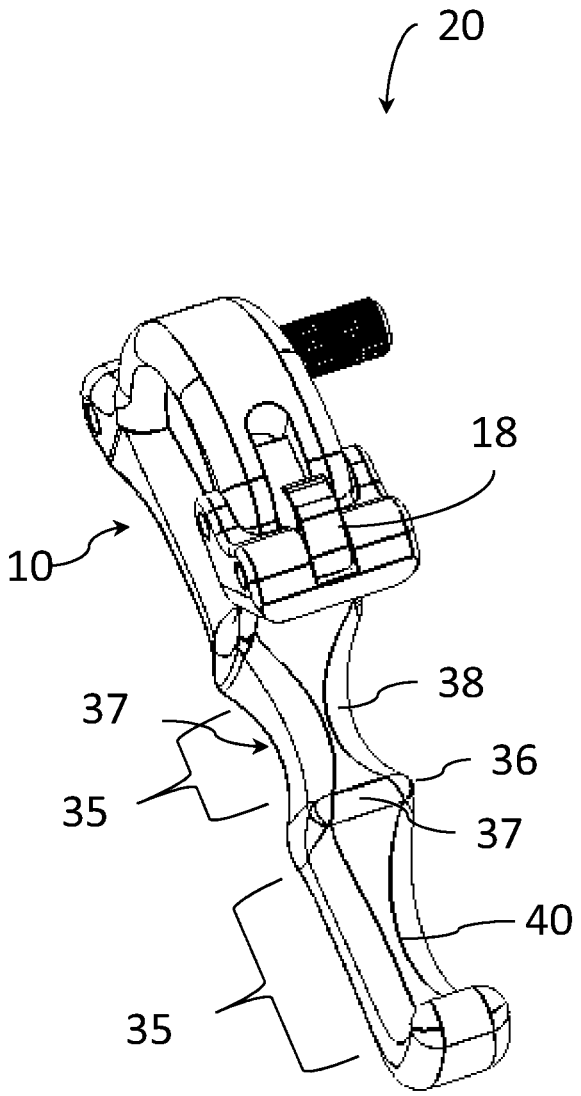
FIG. 12 is an isometric view of the archery release of FIG. 5.
Figure 13:
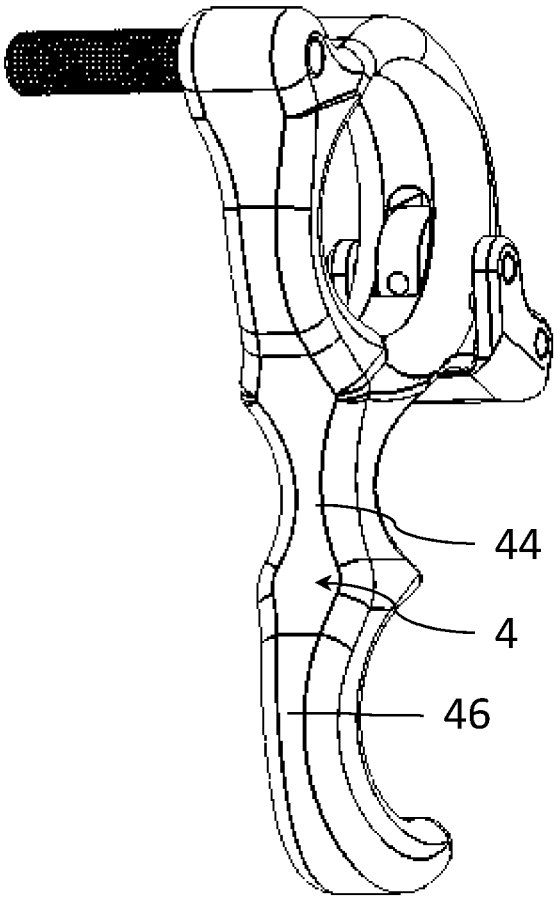
FIG. 13 is an isometric view of the archery release of FIG. 5.
Figure 14:
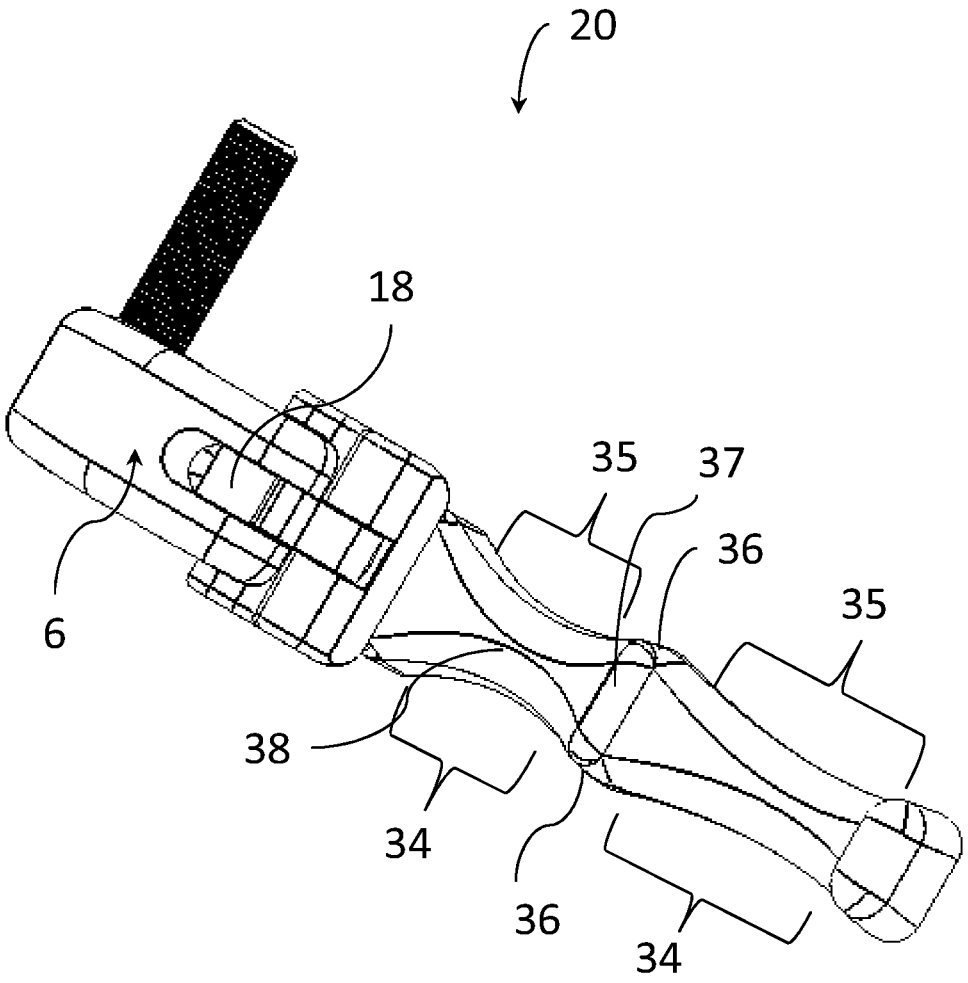
FIG. 14 is a front view of the archery release of FIG. 5.
Figure 15:
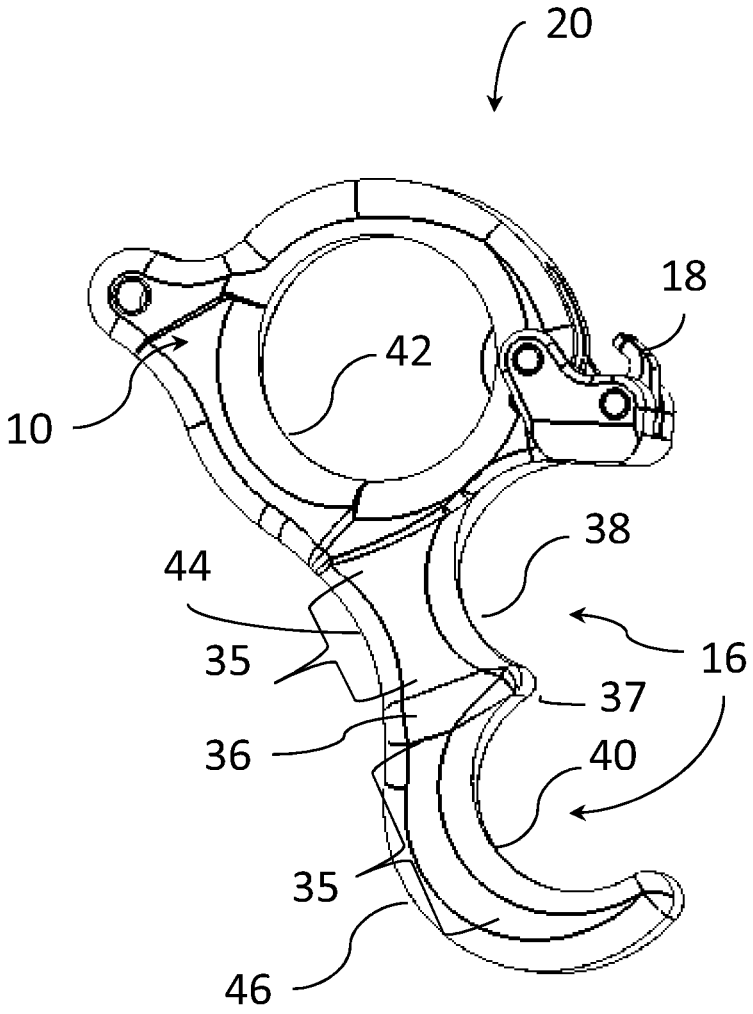
FIG. 15 is a side view of the archery release of FIG. 5.
Figure 16:
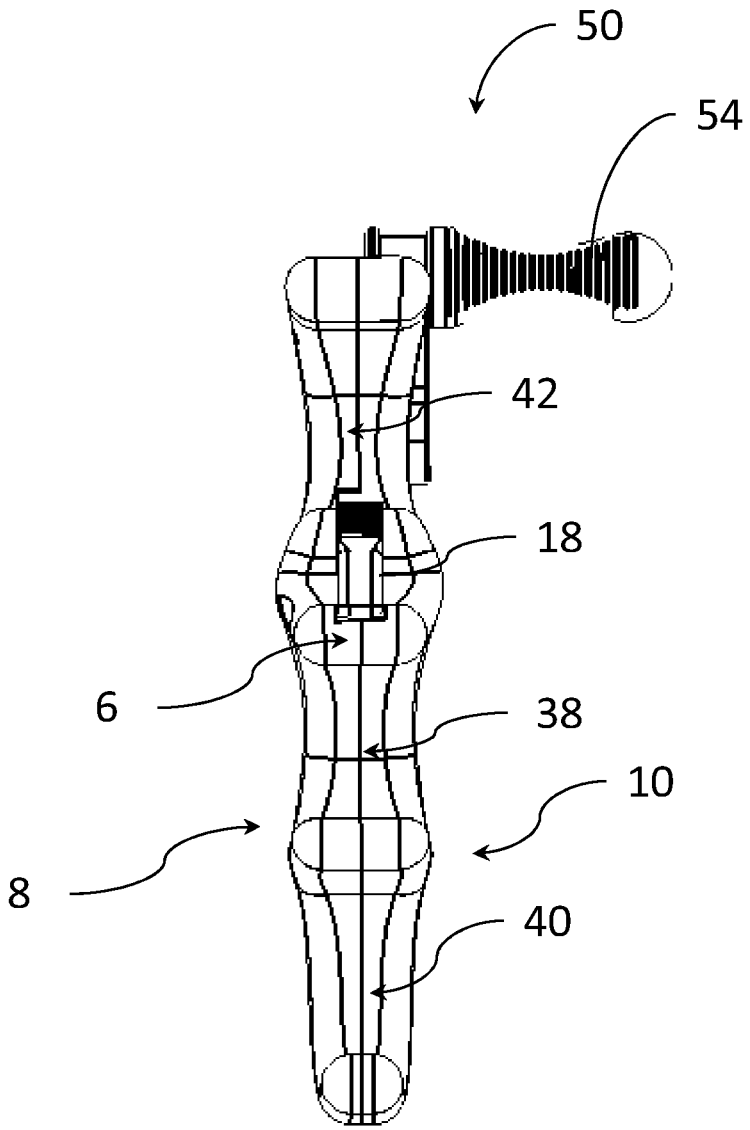
FIG. 16 is a front view of an embodiment of an archery release.
Figure 17:
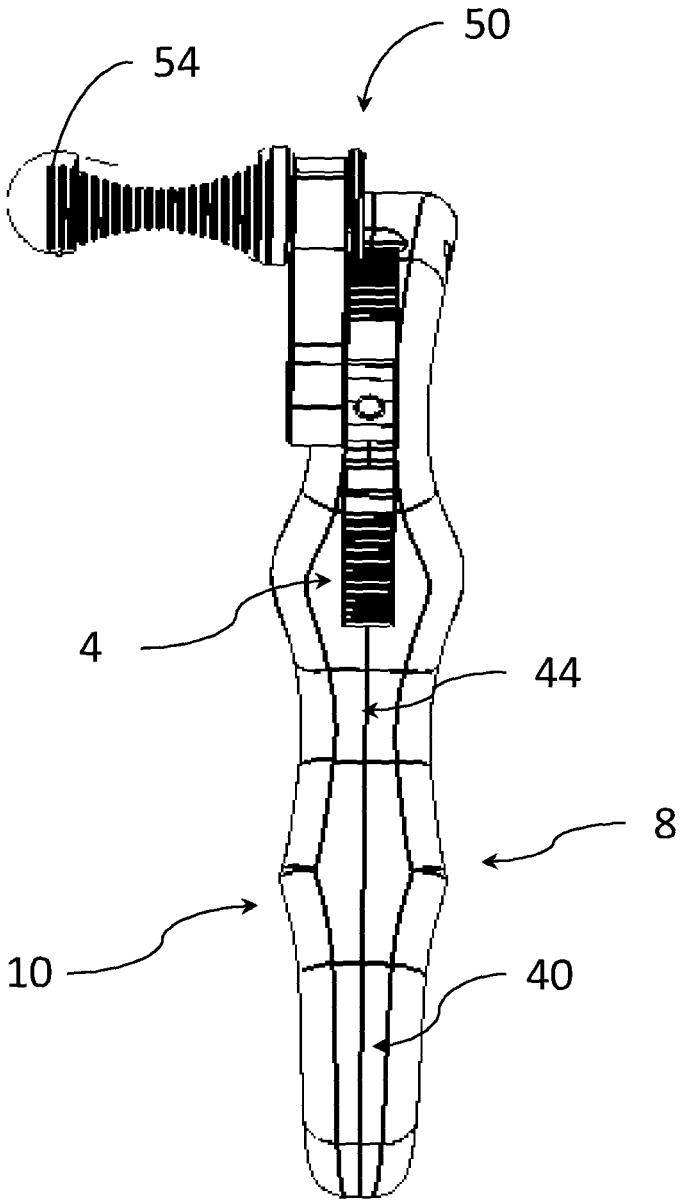
FIG. 17 is a rear view of the archery release of FIG. 16.
Figure 18:
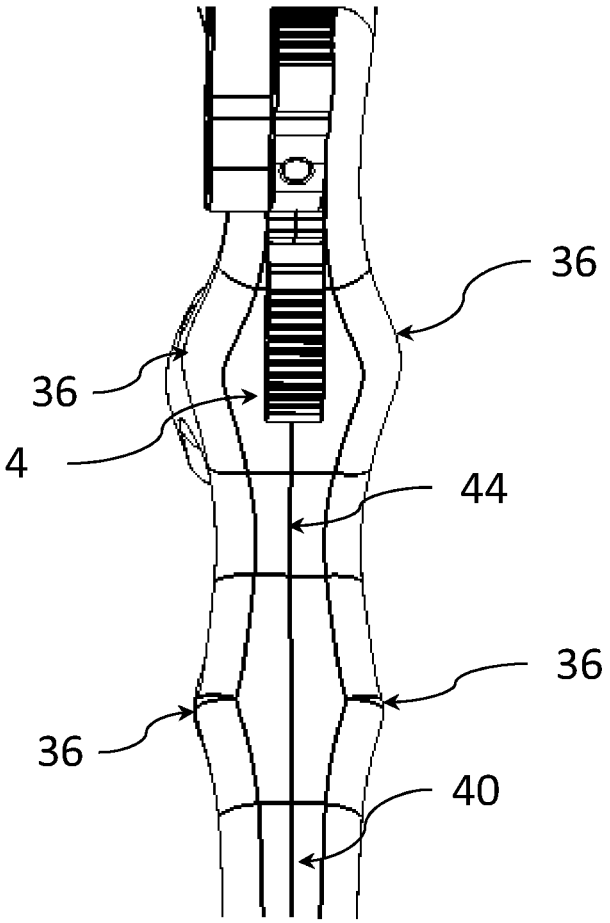
FIG. 18 is an enlarged rear view of the archery release of FIG. 17.
Figure 19:
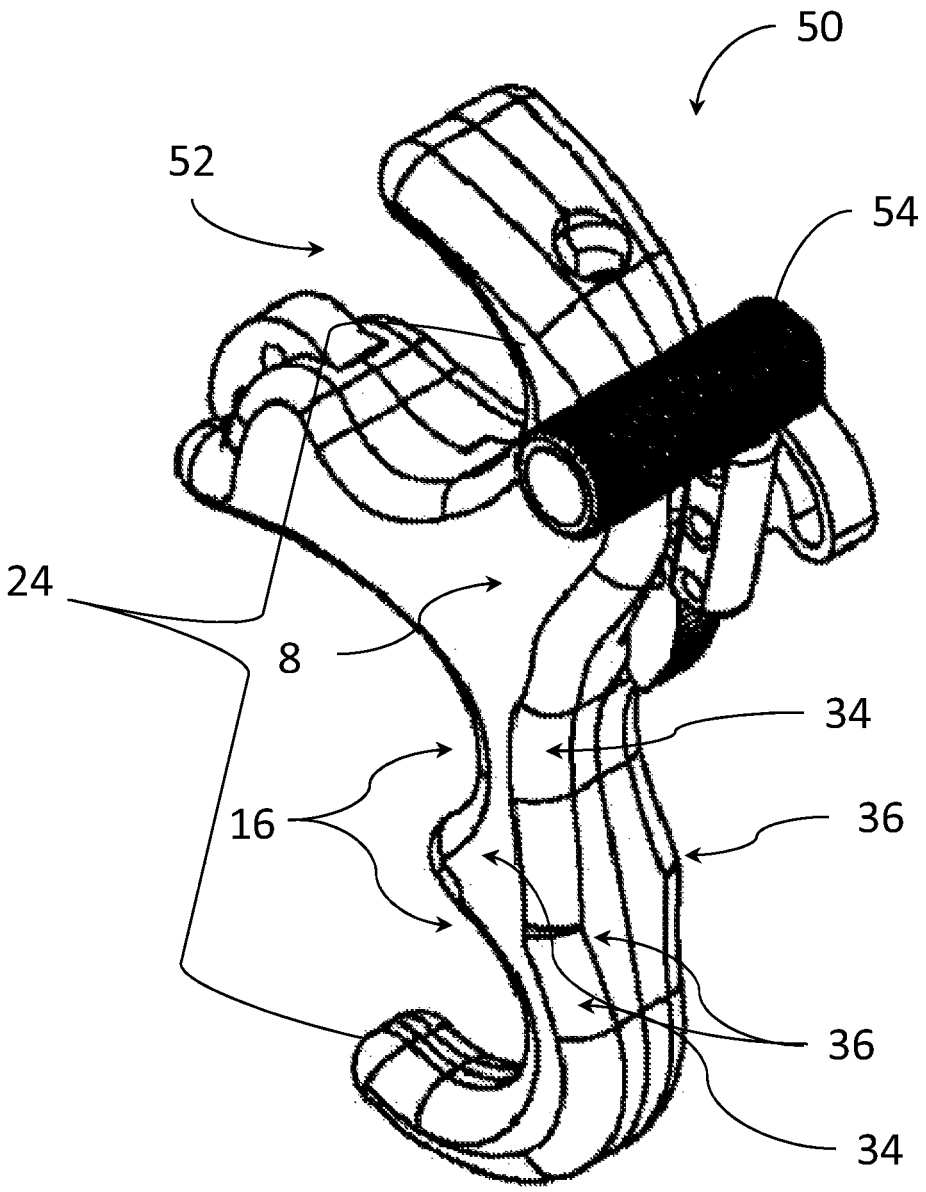
FIG. 19 is an isometric view of the archery release of FIG. 16.
Figure 20:
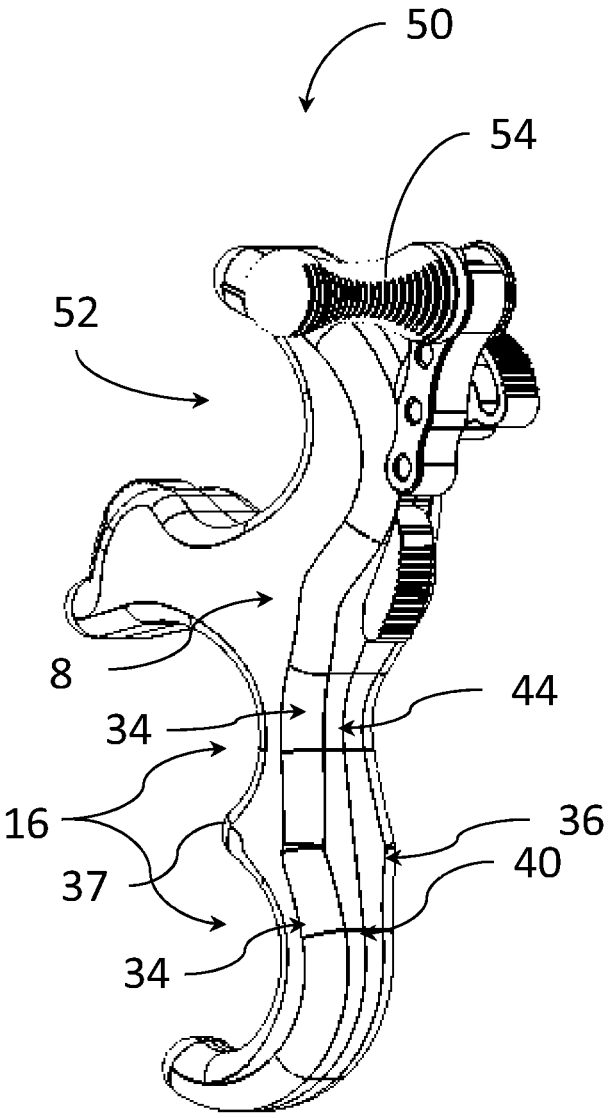
FIG. 20 is an isometric view of the archery release of FIG. 16.
Figure 21:
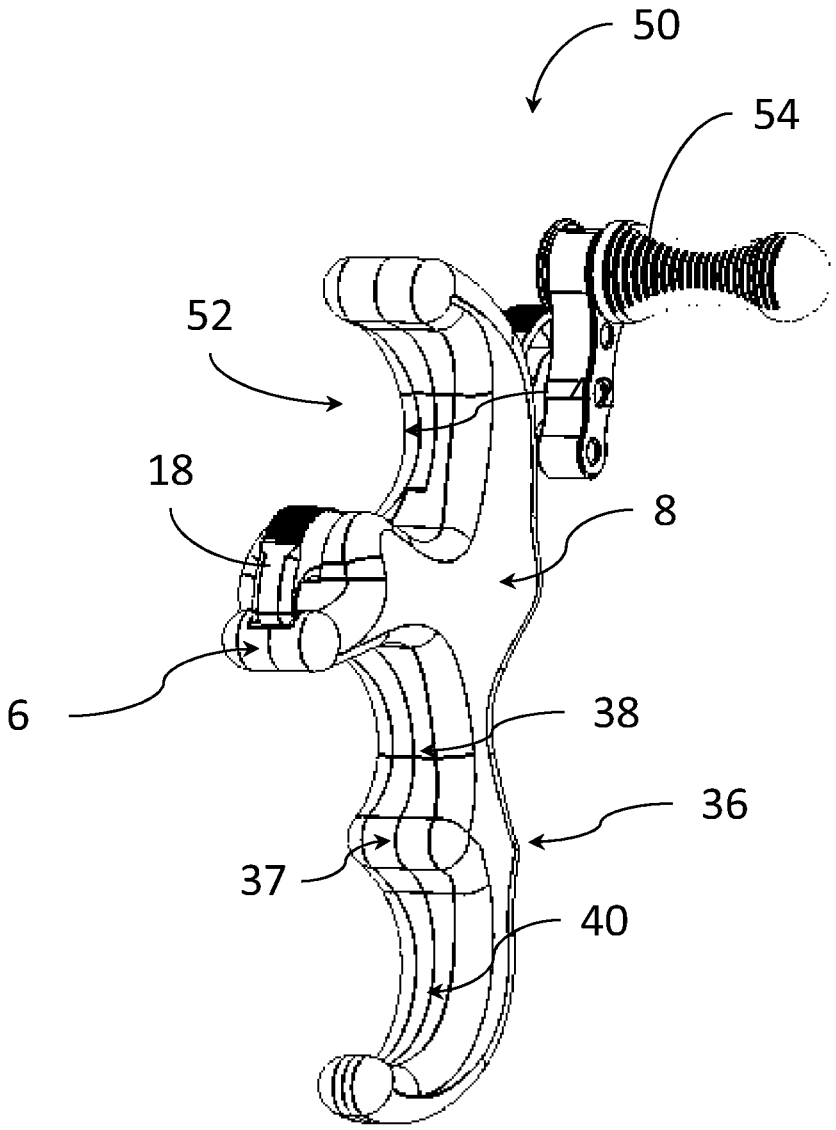
FIG. 21 is an isometric view of the archery release of FIG. 16.
Figure 22:
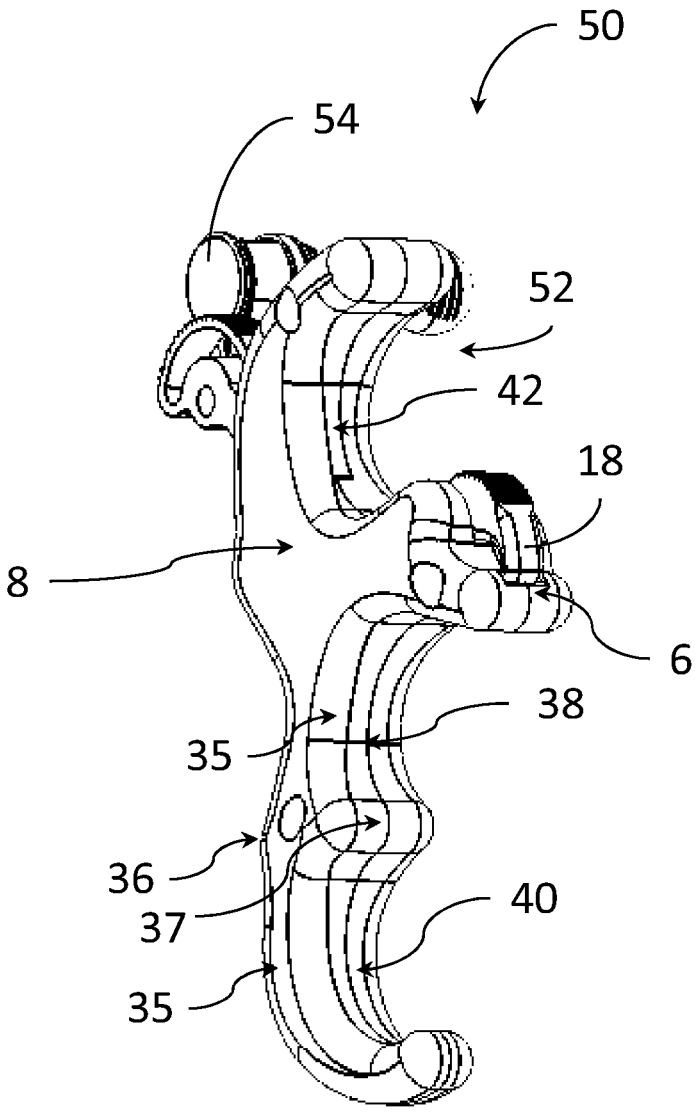
FIG. 22 is an isometric view of the archery release of FIG. 16.
Figure 23:
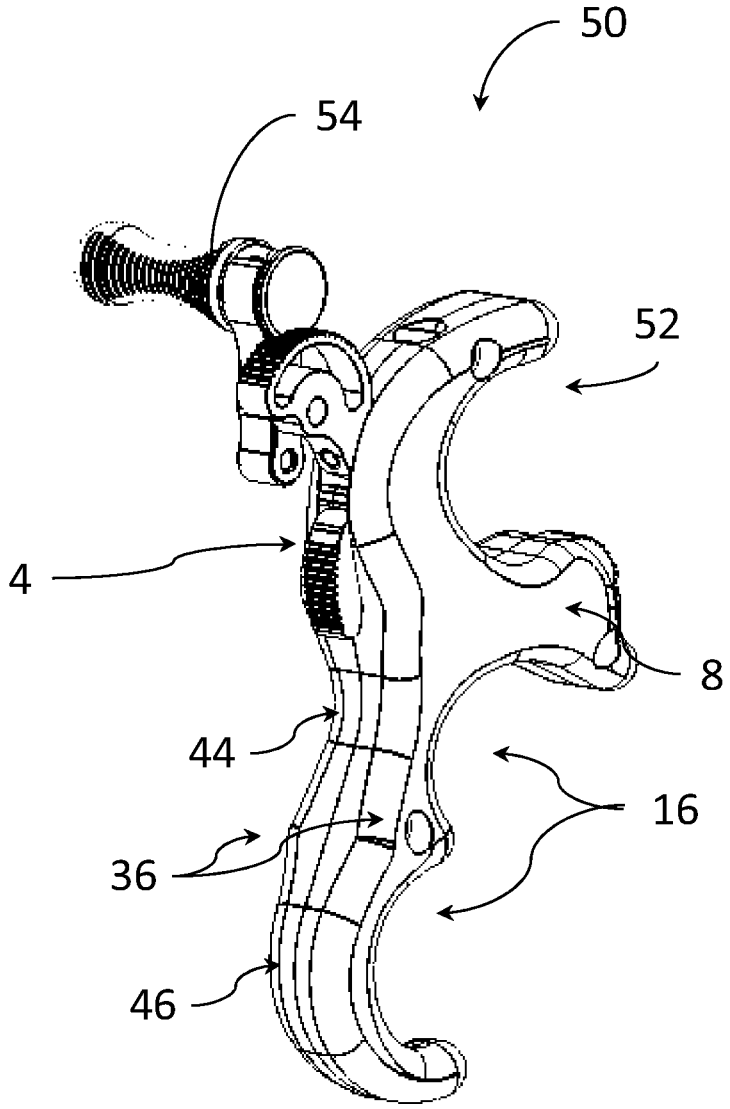
FIG. 23 is an isometric view of the archery release of FIG. 16.
Figure 24:
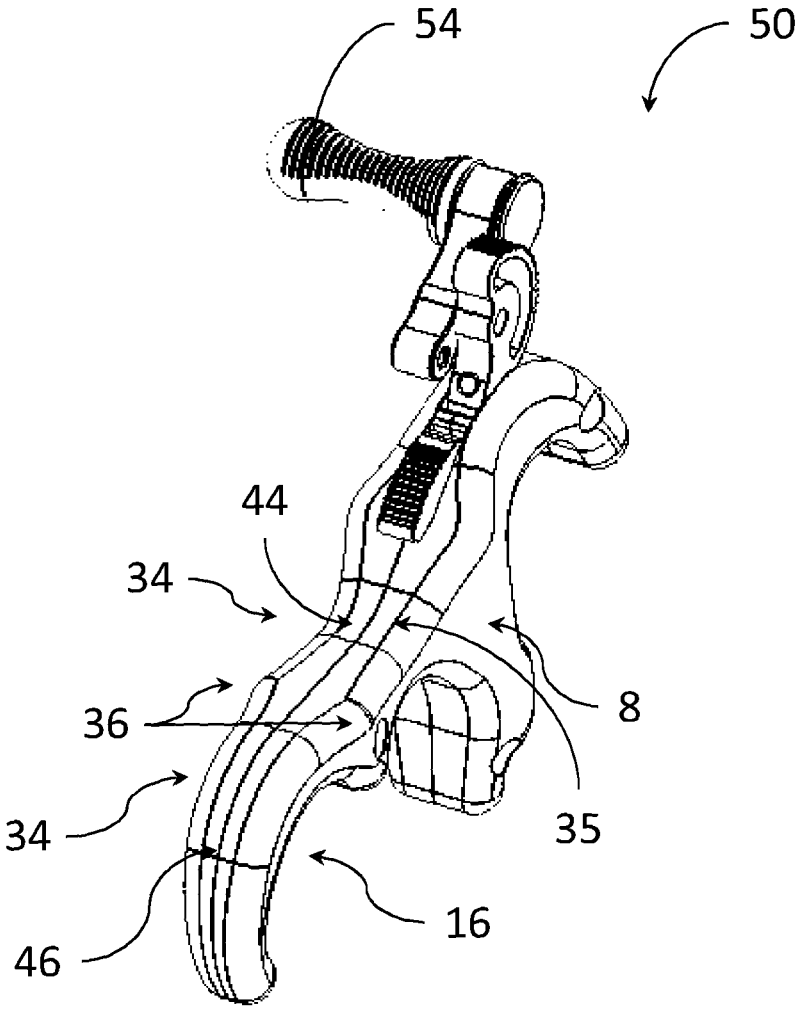
FIG. 24 is an isometric view of the archery release of FIG. 16.
Figure 25:
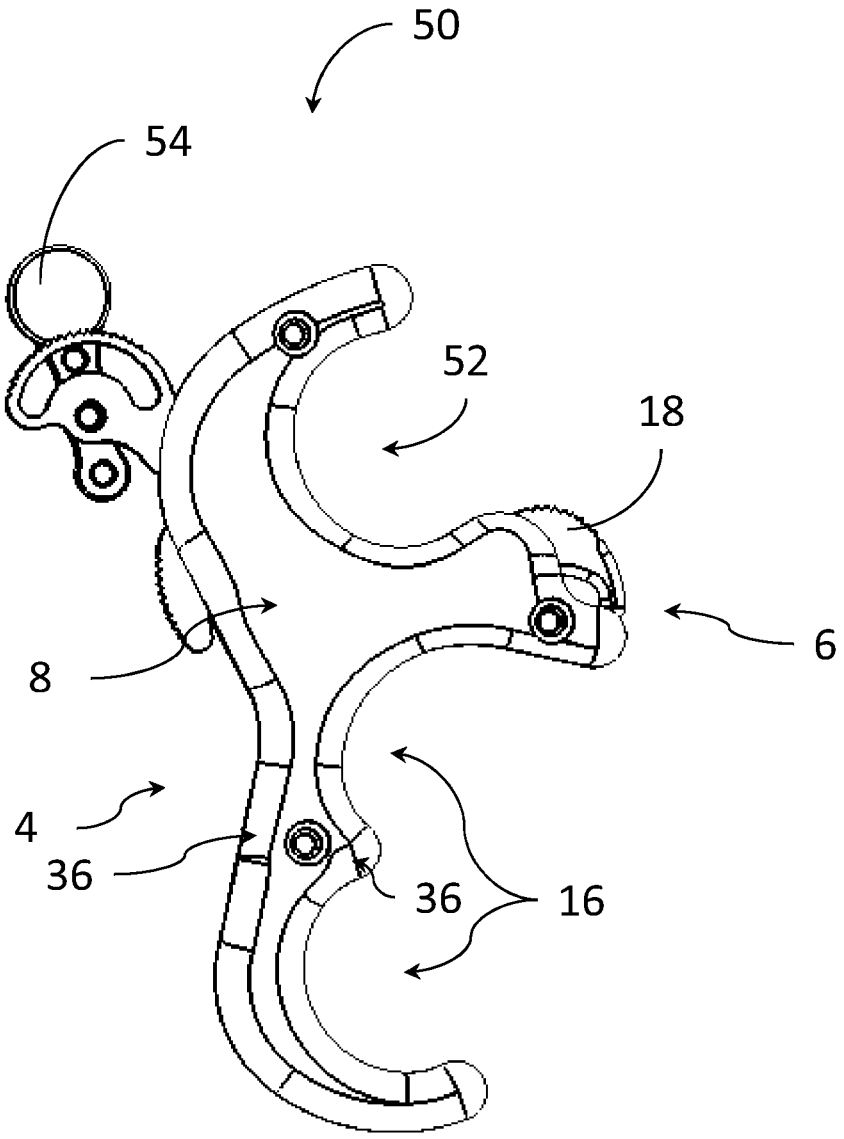
FIG. 25 is a side view of the archery release of FIG. 16.

As described above, each of these finger retention surfaces or interfaces 16, 34, 35 coincides or is associated or aligned with a position of one of the fingers 17, 21, 23. As illustrated in FIG. 12, in an embodiment, the valleys 37 of each interface 16, 34, 35 are joined together to continuously extend across the side surface 8, across the front surface 6, and across the side surface 10. These extended finger positions or joined valleys 37 provide a more secure positioning for the archer's fingers. In an embodiment, the joined valleys 37 for a finger form a partial circular path extending to support the such finger.

Referring to FIG. 6, in an embodiment, the thickness of the archery release 20 is shaped to reach local minimum or relatively low thicknesses 38, 40, 42 relative to the general thickness of the grip member 24 that coincide with each finger interface 16. Thus, these relatively low thicknesses 38, 40, 42 are narrower than the general thickness of the grip member 24. These relatively low thicknesses 38, 40, 42 are positioned to align with the narrower areas of the archer's fingers. In another embodiment, particularly illustrated by FIGS. 10 and 13, an additional minimum or low thickness 44, 46 coincides with each finger interface 16. Each additional low thickness 44, 46 is positioned opposite each low thickness 38, 40 such that at least two low thicknesses coincide with each finger interface 16. For example, for each finger interface 16, a low thickness 38, 40 is located on the front surface 6 and a low thickness 44, 46 is located on the back surface 4. In another embodiment, a local minimum or low thickness is also positioned on each side surface 8, 10 associated with each finger interface 16.

The relative low thicknesses 38, 40, 42 reduce the diameter of the grip member 24 at different locations along its longitudinal axis. As a result, the grip member 24 has a plurality of different diameters, including a relatively low diameter associated with each interface 16 and a relatively high diameter for the other regions of the grip member 24.

As illustrated in FIG. 6, the shape or sculpted profile of each finger interface 16 sweeps downward, making a lead-in for the archer's fingers. In an embodiment, the finger interfaces 16 with their respective local thicknesses 38-46 are strategically positioned higher or lower (i.e. thicker or thinner) to accommodate specific finger positioning In an example, different thicknesses 38-46 are associated with different types of fingers.

Referring to FIGS. 5 and 6, in an embodiment, a first portion of a user's finger is received in a finger interface 16 on the front surface 6 and a second portion of the user's finger is received in a corresponding finger retention surface or interface 34, 35 of a side surface 8, 10. In another embodiment, a first portion of a user's finger is received in a finger retention surface or interface 34 of a first side surface 8, a second portion of the user's finger is received in a corresponding finger interface 16 of the front surface 6, and a third portion of the user's finger is received in a finger retention surface or interface 35 of the second side surface 10. In an additional embodiment, the second side surface 10 additionally at least partially contacts the user's distal palm region 13 (FIG. 3).

Under relatively high bowstring loads or repeated shooting, the archery release 20 eliminates or reduces hand discomfort due to these minimums or low thicknesses 38, 40, 42 and the finger hug configuration of the finger interfaces 16. In some embodiments, the sculpted archery release 20 also provides a tighter anchor point in the archer's hand 5 and the minimums or low thicknesses 38, 40, 42 align with the archer's fingers and enable the archer to grip the archery release 20 better. This tighter anchor point enhances the shooting accuracy or performance of the archer.

The curvilinear shape of the first and second additional interfaces 34, 35 substantially conforms to the shape of an archer's fingers. The conformation of the curvilinear shape improves the feel of the release 20 and provides a more secure positioning of the archer's fingers. Each interface 16, 34 and 35 functions as a finger retainer configured to at least partially surround, and hug, the sides 7 (FIG. 3) of the finger associated with such interface.

Another embodiment of an archery release 50 is illustrated in FIGS. 16-25. In this embodiment, the archery release 50 is a trigger-type release having a button or lever (e.g., lever 54) coupled to a sear mechanism or linkage which, in turn, is coupled to a pivotal hook (e.g., hook 18). In this case, squeezing lever 54 causes the hook 18 to pivot relative to the housing 22 to release the bowstring 29 for firing of the bow. In an embodiment, the archery release 50 includes all of the structure, components, elements, shapes, configuration and functionality of archery release 20 (FIGS. 5-15) except that the index finger interface 52 of the release 50 has a partial circular shape or moon-shape in contrast to the ring-shaped configuration of the index finger interface 52 of the archery release 20.

In the illustrated embodiments, the archery release 20, 50 is a three-finger release for pulling action by the index finger 33, middle finger 21 and ring finger 23. It should be appreciated that the archery release 20, 50 can be lengthened to include an additional finger interface 16 for the pinky finger 19. In an embodiment, the grip member 24 of archery release 20, 50 can include a coating or layer having a resilient, compressible or deformable characteristic to reduce impact on the hand 5 and enhance gripping. For example, such coating or layer can be constructed of a suitable tape, rubber, foam or other polymer.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. An archery bowstring release, comprising:

a bowstring hook configured to hold a bowstring; and a hand grip member connected to the bowstring hook, the hand grip member comprising:

a front surface and a rear surface opposite the front surface, the front surface extending along a pulling plane; and a plurality of side surfaces coupling the front surface to the rear surface, each of the side surfaces extending along a side plane, wherein each of the side surfaces is contoured to define at least a first finger interface and a second finger interface, the first finger interface and the second finger interface separated by a crest extending perpendicular to the pulling plane.

2. The archery bowstring release of claim 1, wherein the crest extends across the side surfaces and the front surface.

3. The archery bowstring release of claim 2, wherein each of the side surfaces is contoured to define a plurality of crests and a third finger interface, each of the first, second and third finger interfaces being separated from each other by one of the crests.

4. The archery bowstring release of claim 1, wherein each of the first and second finger interfaces comprises a concave shape.

5. The archery bowstring release of claim 1, wherein each of the side planes intersects the pulling plane.

6. An archery release, comprising:

a release body comprising:

a grip portion comprising:

a plurality of finger interfaces comprising an index finger interface, a middle finger interface and a ring finger interface;

a front surface defining a plurality of front valleys, each one of the plurality of front valleys at least partially defining one of the finger interfaces;

a rear surface opposite the front surface; and a plurality of side surfaces, each one of the side surfaces defining a plurality of side valleys, each one of the plurality of side valleys at least partially defining one of the finger interfaces; and a bowstring hook coupled to the release body.

7. The archery release of claim 6, wherein at least one of the side valleys comprises a palm engager.

8. The archery release of claim 6, wherein the grip portion comprises at least one peak positioned between each one of the front valleys.

9. The archery release of claim 8, wherein the at least one peak is positioned between each one of the side valleys.

10. The archery release of claim 8, wherein the at least one peak extends across the side surfaces and the front surface.

11. The archery release of claim 6, wherein the grip portion comprises a first thickness and wherein each of the finger interfaces comprises a second thickness different from the first thickness.

12. The archery release of claim 11, wherein the second thickness is less than the first thickness.

13. The archery release of claim 6, wherein the front valleys extend along a pulling plane.

14. The archery release of claim 13, wherein each of the side valleys extend along a side plane that intersects the pulling plane.

15. An archery release, comprising:

a grip member comprising a first diameter, a front and a plurality of sides, the grip member further comprising a three-dimensionally contoured shape extending at least around the front and the sides, the contoured shape defining at least a first finger interface and a second finger interface, wherein the first and second interfaces each comprise a second diameter which is less than the first diameter; and a bowstring holder coupled to the grip member, wherein the front defines a plurality of front valleys, and each one of the sides defines a plurality of side valleys.

16. The archery release of claim 15, wherein the grip member defines a plurality of valleys and at least one peak between the valleys, wherein each one of the valleys at least partially defines the second diameter.

17. The archery release of claim 15, wherein each one of the finger interfaces comprises the front valley and a plurality of the side valleys.

18. The archery release of claim 15, wherein: (a) a first one of the side valleys comprises a palm engager; and (b) a second one of the side valleys comprises a phalanx engager.

19. The archery release of claim 18, wherein: (a) the second side valley is located opposite of the first side valley; and (b) the front and each one of the sides has a curved shape.

20. The archery release of claim 15, wherein:

the archery release is configured to be held in a shooting position in which the front at least partially faces toward a shooting target;

the bowstring holder comprises a hook moveably coupled to the grip member;

the archery release comprises an index finger support comprising a shape which is at least partially circular, wherein the index finger support is configured to engage an index finger of a user;

the front comprises a wave-shape;

each one of the sides comprises a non-stepped, wave-shape;

the front comprises a front surface configured to at least partially engage a proximal phalanx of an additional finger of the user;

a first one of the sides is configured to at least partially engage a distal palm region of the additional finger; and a second one of the sides is configured to at least partially engage a middle phalanx of the additional finger.

* * * * *